US010968788B2

(12) United States Patent
McCarthy, Jr. et al.

(10) Patent No.: US 10,968,788 B2
(45) Date of Patent: Apr. 6, 2021

(54) TWO-PART LIFTER ASSEMBLY

(71) Applicant: Eaton Intelligent Power Limited, Dublin (IE)

(72) Inventors: James E. McCarthy, Jr., Kalamazoo, MI (US); Leighton Roberts, Kalamazoo, MI (US); Ryan Krieger, Portage, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/755,742

(22) PCT Filed: Jan. 31, 2019

(86) PCT No.: PCT/EP2019/025032

§ 371 (c)(1),
(2) Date: Apr. 13, 2020

(87) PCT Pub. No.: WO2019/149454

PCT Pub. Date: Aug. 8, 2019

(65) Prior Publication Data

US 2020/0325800 A1 Oct. 15, 2020

Related U.S. Application Data

(60) Provisional application No. 62/624,623, filed on Jan. 31, 2018.

(51) Int. Cl.
*F01L 1/24* (2006.01)
*F01L 1/04* (2006.01)
(Continued)

(52) U.S. Cl.
CPC ..... *F01L 1/2422* (2013.01); *F01L 1/04* (2013.01); *F01L 1/18* (2013.01); *F01L 13/0005* (2013.01);
(Continued)

(58) Field of Classification Search
CPC ... F01L 1/14; F01L 1/146; F01L 1/181; F01L 2001/2427; F01L 1/245; F01L 2001/256;
(Continued)

(56) References Cited

U.S. PATENT DOCUMENTS 2,797,673 A * 7/1957 Black ..... F01L 1/245 123/90.55
2,840,063 A * 6/1958 Purchas, Jr. ..... F01L 1/245 123/90.55
(Continued)

FOREIGN PATENT DOCUMENTS

DE 102015220628 B3 10/2016
WO WO-0042300 A1 7/2000
(Continued)

OTHER PUBLICATIONS

International Search Report and Written Opinion for PCT/EP2019/025032 dated Jul. 26, 2019; pp. 1-16.

*Primary Examiner* — Jorge L Leon, Jr.
(74) *Attorney, Agent, or Firm* — Mei & Mark, LLP

(57) ABSTRACT

A roller-lifter assembly for a cam-actuated engine, comprising a two-part roller lifter (10, 13, 16) comprising a pump actuator main body, a receiving portion extending from the main body (160, 161, 162, 163 164), and a cam follower comprising a roller assembly (31) or a flat tappet integrated to the main body and configured to follow a rotating cam of a cam-actuated (32) engine. A hydraulically-actuated capsule (200, 202, 203, 204, 205) is fitted to the receiving portion of the pump actuator, the capsule configured to rotate with respect to the pump actuator (100, 101, 102, 103, 104).

20 Claims, 7 Drawing Sheets

(51) Int. Cl.

| | |
|---|---|
| ***F01L 1/18*** | (2006.01) |
| ***F01L 13/00*** | (2006.01) |
| ***F01M 9/10*** | (2006.01) |
| *F01L 1/245* | (2006.01) |

(52) U.S. Cl.
CPC ..... *F01M 9/10* (2013.01); *F01L 2001/2427* (2013.01); *F01L 2001/256* (2013.01); *F01L 2013/001* (2013.01); *F01L 2305/02* (2020.05)

(58) Field of Classification Search
CPC ..... F01L 13/0005; F01L 2013/001; F01L 2307/00
USPC ..... 123/90.12, 90.48, 90.5, 90.55
See application file for complete search history.

(56) References Cited

U.S. PATENT DOCUMENTS

| | | | | |
|---|---|---|---|---|
| 2,874,684 | A * | 2/1959 | Thompson | F01L 1/245 123/90.55 |
| 2,932,290 | A * | 4/1960 | Christensen | F01L 1/245 123/90.51 |
| 5,566,652 | A | 10/1996 | Deppe | |
| 6,557,518 | B1 | 5/2003 | Albertson et al. | |
| D701,243 | S | 3/2014 | Cornett et al. | |
| 9,243,521 | B2 | 1/2016 | Cornett et al. | |
| 9,702,309 | B2 | 7/2017 | Haynes et al. | |
| 2002/0134338 | A1 | 9/2002 | Haas et al. | |
| 2002/0195072 | A1 | 12/2002 | Spath et al. | |
| 2016/0341077 | A1 | 11/2016 | Pomerleau | |
| 2019/0153905 | A1 | 5/2019 | Stretch | |

FOREIGN PATENT DOCUMENTS

| | | | |
|---|---|---|---|
| WO | WO-2015/106051 | A1 | 7/2015 |
| WO | WO-2016/115346 | A1 | 7/2016 |
| WO | WO-2017/053867 | A1 | 3/2017 |
| WO | WO-2017/143111 | A1 | 8/2017 |
| WO | WO-2017/196665 | A1 | 11/2017 |

* cited by examiner

TWO-PART LIFTER ASSEMBLY

This is a § 371 National Stage Entry claiming the benefit of priority of PCT/EP2019/025032 filed Jan. 31, 2019 and claims the benefit of U.S. provisional application No. 62/624,623, filed Jan. 31, 2018, all of which are incorporated herein by reference.

FIELD

This application provides a roller lifter or flat tappet lifter assembly for a cam-actuated engine.

BACKGROUND

Valve lifters typically comprise a single piece of stock material inserted in the bottom of a Type IV or Type V engine block. With the cam rail below the piece of stock, it is difficult to service the valve lifter. Additionally, it is difficult to provide upgrades to the piece of stock during service intervals.

SUMMARY

This application relates to a two-part roller lifter or flat tappet lifter device for a valvetrain. Cylinder deactivation alternatives are provided. Techniques for permitting a hydraulic lash adjuster to rotate within the lifter are provided. Lubrication techniques for the hydraulic lash adjuster are provided.

A lifter assembly for a cam-actuated engine comprises a two-part lifter comprising a pump actuator main body, a receiving portion extending from the main body, and a cam follower comprising a roller assembly or a flat tappet integrated to the main body and configured to follow a rotating cam of a cam-actuated engine. A hydraulically-actuated capsule is fitted to the receiving portion of the pump actuator, the capsule configured to rotate with respect to the pump actuator.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

DETAILED DESCRIPTION

Figure 1B:
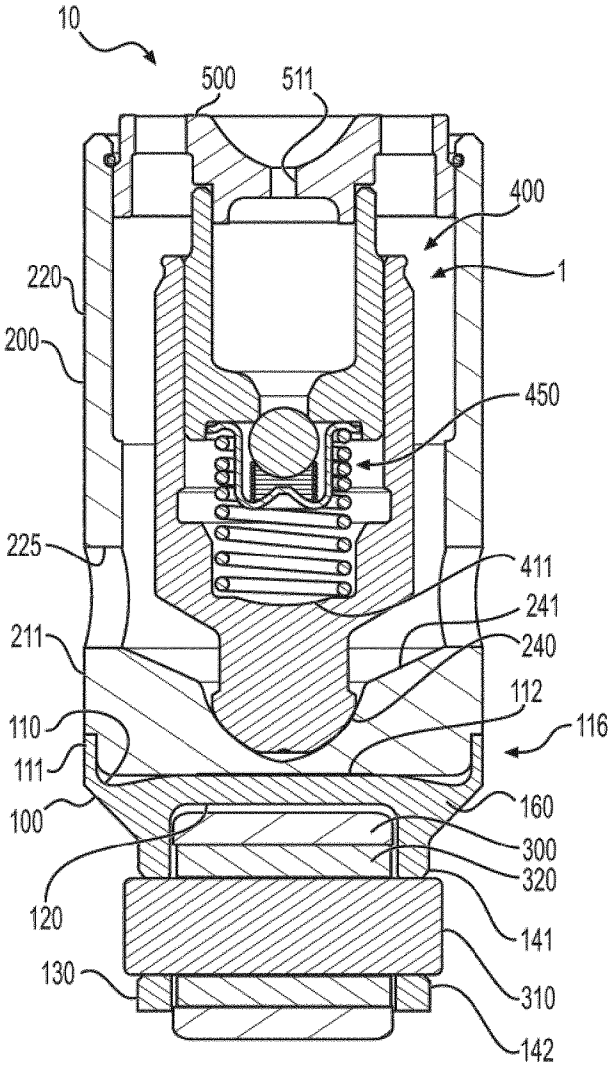
FIGS. 1A & 1B are alternative views of a two-part lifter.
Figure 1A:
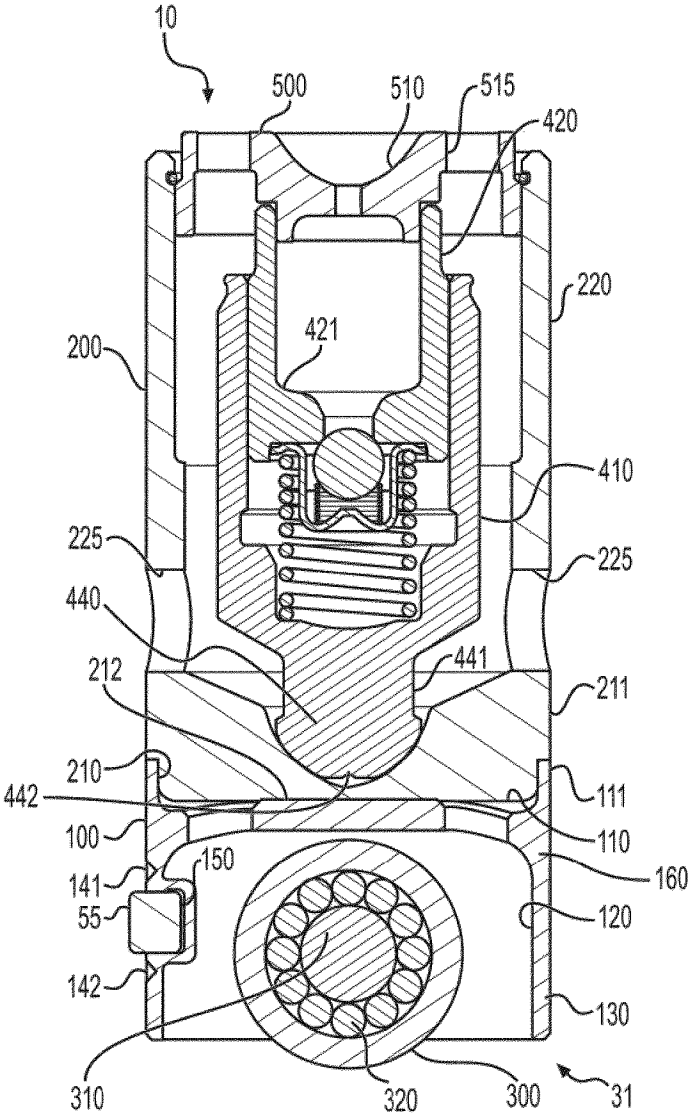

Reference will now be made in detail to the examples which are illustrated in the accompanying drawings. Wherever possible, the same reference numbers will be used throughout the drawings to refer to the same or like parts.

A pump actuator 100, 101, 102, 103, 104 can be equipped with an anti-rotation device 55, 56. The pump actuator can mate with a hydraulically-actuated capsule 200, 202, 203, 204, 205 fitted to a receiving portion 106, 113, 116, 117 of the pump actuator. The hydraulically-actuated capsule 200, 202, 203, 204, 205 can be configured to rotate with respect to the pump actuator 100-104. The hydraulically-actuated capsule can comprise a variety of devices, such as a hydraulic lash adjuster (HLA) 1, 2, 6, or other variable valve actuation (VVA) device such as a cylinder deactivation (CDA) actuator 5, engine braking actuator, early or late valve opening or closing actuators for lift profiles such as late intake valve closing (LIVC), among others. The hydraulically-actuated capsule can comprise a combination of hydraulic components, such as the CDA actuator 5 and HLA 3, 4 combinations shown in FIGS. 5 & 6. Or, the hydraulically-actuated capsule can comprise a combination of mechanical and hydraulic components, such as a mechanical lash adjuster in tandem with a VVA device such as a CDA actuator or engine braking actuator.

Using the two-part design, it is easier to customize the hydraulically-actuated capsule, permitting upgrades and design changes among customers and even among scheduled maintenances. For example, a customer can switch between mechanical lash and hydraulic lash during a service interval. Or, a customer can add or switch WA components such as CDA actuator or HLA plus CDA without complete engine rebuild. The hydraulically-actuated capsule can be switched out or serviced while the pump actuator remains in the engine block.

The hydraulically-actuated capsule 200, 202, 203, 204, 205 can rotate while the pump actuator 100-104 does not rotate. This places less wear on the hydraulically-actuated capsule and freshens the oil interface in ways that fully stationary lifter assemblies cannot. For example, in lifters that cannot rotate, a single wear point can develop between the engine block and the lifter or between the push tube and the lifter and oil can migrate to permit metal-to-metal contact. If the two-part lifter is used, and the pump actuator 100-104 is kept stationary, and the hydraulically-actuated capsule 200, 202, 203, 204, 205 can rotate, the oil interfaces can freshen as the capsule rotates. In the examples of FIGS. 1A, 1B, 5-7, the hydraulic device 1, 3, 4, 5 can rotate within its hydraulically-actuated capsule 200, 203, 204. When the capsule is sleeved, the sleeve 220, 223, 224 can also rotate and have freshened oil interfaces. The cap 500, 501, 502 can rotate relative to the push tube 40. With an anti-rotation device 55, 56 placed close to the cam 30, the light weight pump actuator 100-104 has a high capacity to resist rotation. And, with the sleeve, cap, and/or hydraulically-actuated capsule permitted to rotate, there are less forces on the anti-rotation device 55, 56, improving its reliability. The two-part lifter of the lifter assembly can be placed between a cam 30 and a push tube 40 in an engine block 60 so as to actuate or deactivate valves 81 of combustion cylinders.

An additional benefit of the two-part lifter is that the pump actuator can be installed in the engine block 60 with its high-life anti-rotation device 55, 56. When it is desirable to exchange or service the hydraulically-actuated capsule, it can be lifted out of the engine block 60 and serviced or exchanged, with easy drop-in assembly.

A two-part lifter assembly provides a lower roller pump actuator 100-104 with an anti-rotation feature 55, 56 in an anti-rotation pocket 150, 151. The pump actuator is very light. The hydraulically-actuated capsule 200, 202, 203, 204, 205 is on top and is allowed to rotate. This makes it easier to customize the upper interface for the push tube 40, because the upper surface can be flat or convex as desired. The HLA is allowed to rotate. The greatly reduces the mass acting on the anti-rotation feature 55, 56. The anti-rotation feature can be an insert 55, such as a block, peg, or clip. The clip is less prone to fail in the two-part lifter assembly. A mass problem is also eliminated. The main body 160, 162, 164 can comprise an anti-rotation insert 55 configured to lift and lower in the anti-rotation slot 65 in the lifter recess 62 while preventing rotation of the main body. Lubrication can leak down into the anti-rotation slot 65.

Figure 2:
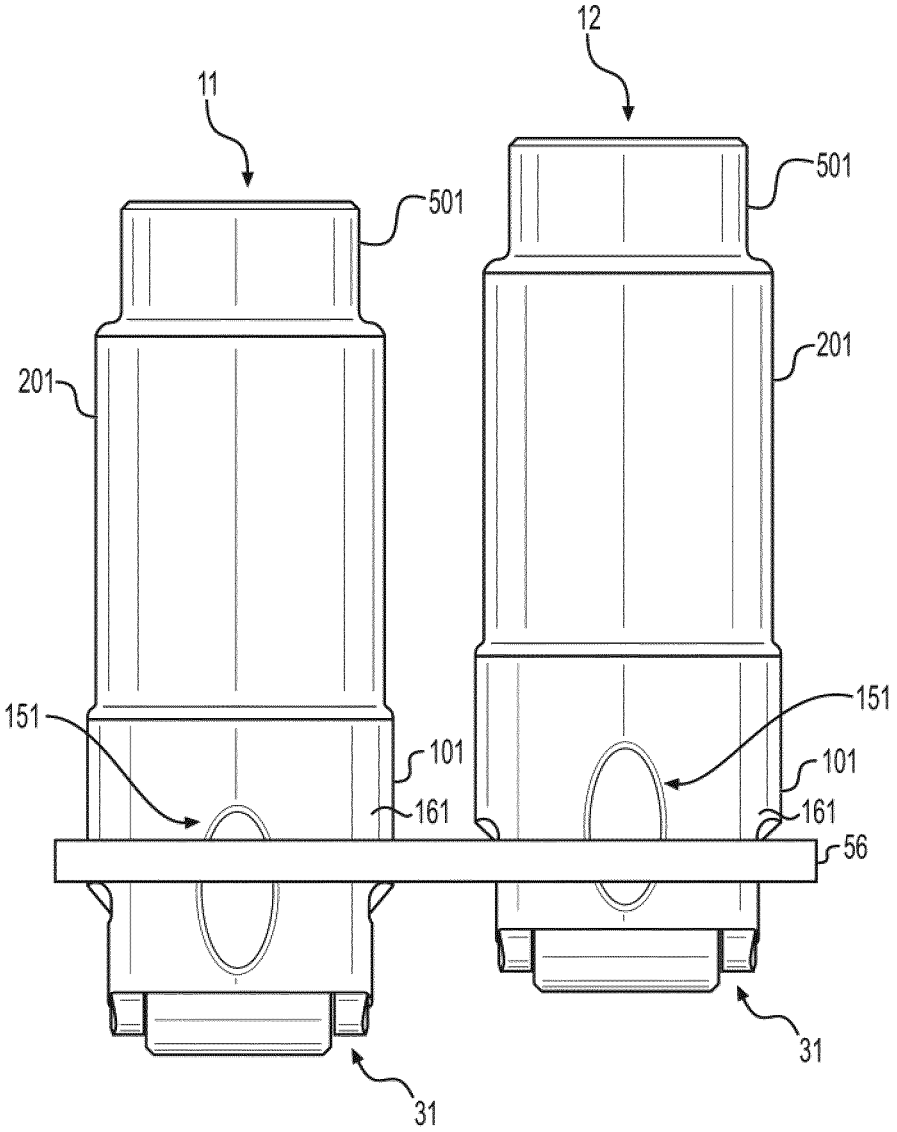
FIG. 2 is a view of two-part lifters on base circle and on lift with respect to an anti-rotation feature.
Figure 3:
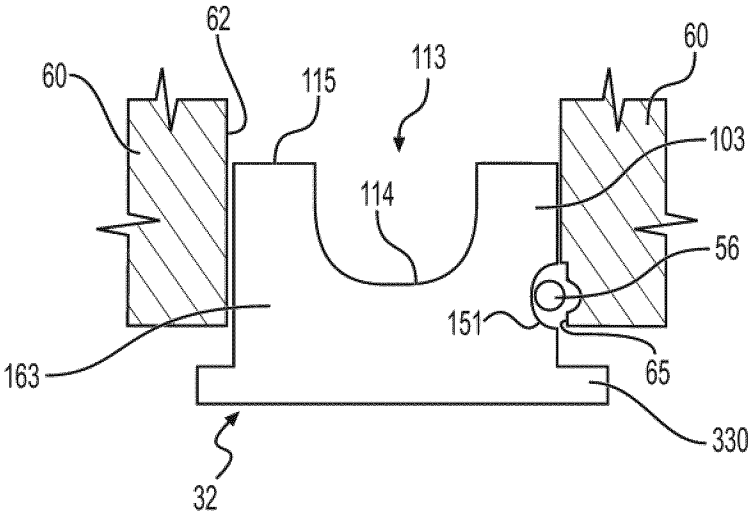
FIG. 3 is a view of an alternative pump actuator.

Alternative to the insert 55 in anti-rotation pocket 150, which can track the size and shape of the insert 55, another anti-rotation feature can comprise a bar 56 that rides in a concave alignment pocket 151. As shown in FIGS. 2 & 3, as the cam 30 rotates between lift profiles and base circle, the two-part lifters 11, 12 lift and lower in the engine block 60. Two-part lifter 11 is shown at a base circle position, while two-part lifter 12 is shown on-lift. The engine block 60 comprises a lifter recess 62 and an anti-rotation slot 65. The lifter recess 62 can comprise an anti-rotation slot 65, which can comprise a lubrication gallery or can be a dry slot. The alignment bar 56 can be mounted in the lubrication gallery, or the lubrication gallery can leak on to the alignment bar 56. The two-part lifter is mounted in the lifter recess 62. The main body 161 or 163 of the pump actuator 101 or 103 comprises an anti-rotation pocket 151 recessed into the main body 161 or 163. The anti-rotation feature in the form of bar 56 is mounted in the anti-rotation pocket 151 and in the anti-rotation slot 65. The bar 56 can ride in the anti-rotation pocket 151 as the lifter moves up and down and then the roller assembly 31 or flat tappet 32 cannot twist relative to the rotating cam 30. The anti-rotation feature is an alignment bar 56 mounted in the lifter recess 62, and the main body 161 or 163 is configured to lift and lower relative to the alignment bar 56. But, the main body 161 or 163 cannot twist in the lifter recess 62 against the alignment bar 56.

If oil leak down is not desired, it could be eliminated by interfacing the two halves of the two-part lifter appropriately, such as flat-on-flat press-fitting, as seen between the step 210 in sleeve 220 and the coupling rim 111 of the receiving portion 116 extending from main body 160. Sleeve 220 can comprise a flat 212 on a base 211 that can couple to a seat 112 of the receiving portion 116. A pocket 110 can remain between the base 211 of the sleeve 220 and the receiving portion 116. Alternatively, step 210 and coupling rim 111 can be threaded, or can be slip fit to permit rotation of the sleeve in the receiving portion 116. Oil leak-down can be facilitated by leaking between the coupling rim 111 and step 210 and permitting leak between pocket 110 and a hole 121 in the body 160 of the pump actuator 100. The roller assembly 31 can be lubricated via this leak-down.

As above, serviceability is greatly improved. The roller assembly 31 or flat tappet 32 does not need to be moved to service the HLA 1, 2, 3, or 6. The push tube 40 can be removed from the top of the engine block 60, the HLA or other hydraulic device and or the hydraulically-actuated capsule itself can be replaced or serviced, then the push tubes set back down on the new or serviced hydraulically-actuated capsule. The cam 30 and cam rail do not need to be touched to change the HLA or other hydraulically-actuated capsule. The pump actuator remains in alignment, and the new or serviced hydraulically-actuated capsule is easily aligned in the existing engine block.

Because the hydraulically-actuated capsule is seated in the engine block 60, its motion comprises the permissible up-and-down motion imparted by the cam 30. However, due to the two-part design, wherein the HLA and CDA components, among others, are in one half and the roller assembly 31 or tappet 32 is in another half, the HLA among others can rotate. So, no anti-rotation device is needed on the HLA or the CDA or other hydraulically-actuated capsule aspects of the assembly.

The manufacturing tolerance is reduced, because installation is more stable, and because the location of the anti-rotation feature 55, 56 is ideally located to withstand forces from the cam 30 and push tubes 40.

Figure 8:
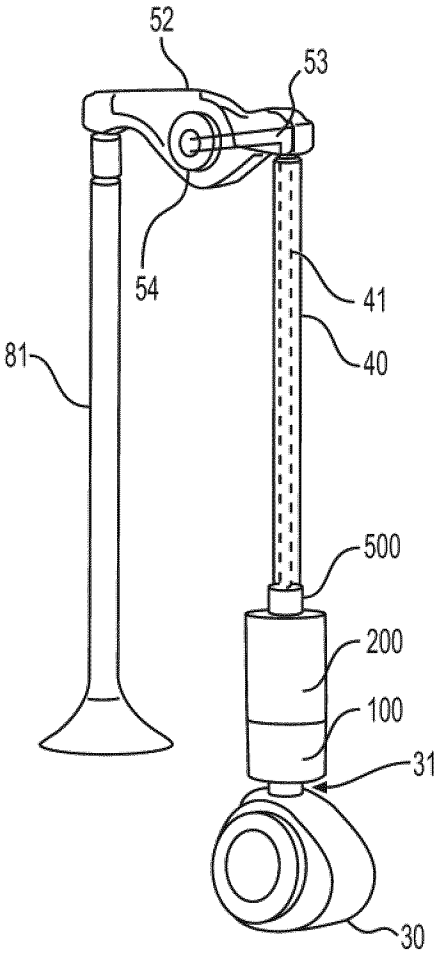

In an alternative embodiment, it is possible to provide a pressurized or unpressurized ("drip") oil feed to the two-part lifter in order to lubricate the hydraulic lash adjuster, lubricate the roller, or actuate the cylinder deactivation capsule of the disclosed embodiments. A lifter assembly according to FIG. 8 can comprise a valve 81 for opening and closing an intake or exhaust port of a combustion cylinder. The valve can be connected to a rocker arm 52. An oil-fed rocker shaft can pass through a rocker mount 54 so that the oil-fed rocker shaft can selectively feed a first oil gallery 53 in the rocker arm 52. By coupling the hollow push tube 40 to the first oil gallery 53, oil can traverse the second oil gallery 41 to the two-part lifter. The push tube 40 can by mounted in or to the cap 500 to form a pressurized or unpressurized connection to the two-part lifter. If pressurized, the oil traverses internally within the hydraulically-actuated capsule 200. If unpressurized, the oil can drip in and around the hydraulically-actuated capsule 200.

Figure 9:
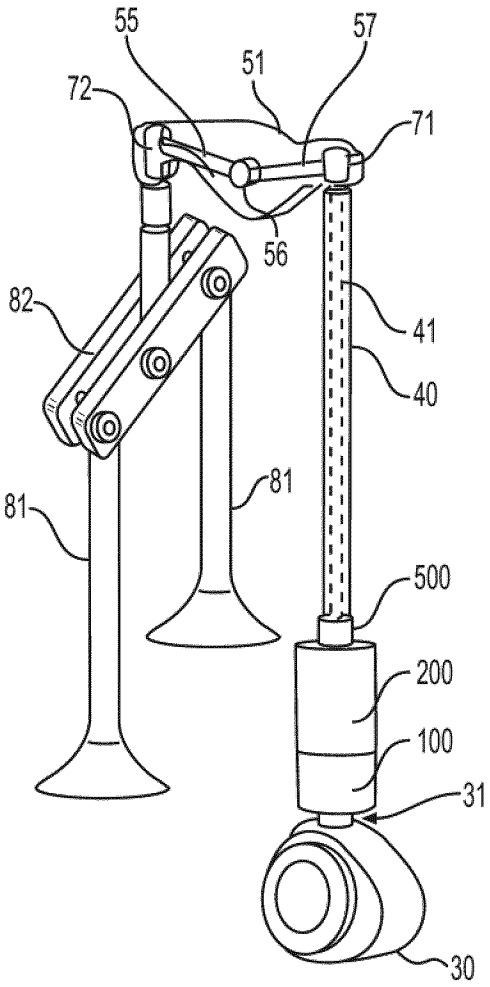
FIGS. 8 & 9 are alternative views of lifter assemblies comprising valve actuation assemblies.

In the lifter assembly of FIG. 9, the rocker arm 51 comprises two oil galleries 55, 57 on either side of the rocker mount 56. Additional functionality can be housed in the optional capsules 71, 72 in the rocker arm, such as an engine brake capsule 72 or cylinder deactivation capsule 71, among other functionality. Oil supplied to the capsule 71 can flow through to the second oil gallery 41. Valves 81 are connected to a bridge 82 before connecting to the rocker arm 51.

A lifter assembly for a cam-actuated engine can comprise a two-part lifter 10, 11, 12, 13, 14, 15, 16 comprising a pump actuator 100, 101, 102, 103, 104. The pump actuator can respectively comprise a main body 160, 161, 162, 163, 164. A receiving portion 116, 106, 113, 117 extends from the main body. A cam follower comprising a roller assembly 31 or a flat tappet 32 is integrated to the main body and is configured to follow a rotating cam 30 of a cam-actuated engine.

The roller assembly 31 can be mounted in a hollow 120 of the pump actuator 100. The hollow 120 can be formed by mounting material 130 extending from the main body 160. The anti-rotation pocket 150 can be stamped or otherwise formed in the mounting material 130, as can lubrication slots 141, 142. A bearing shaft 310 can be mounted to the mounting material 130. An outer bearing 300 and optional needle bearings can surround the bearing shaft 310.

In FIG. 1, the hydraulically-actuated capsule 200 of the two-part lifter 10 further comprises a sleeve 220 mounted to the pump actuator 100. The sleeve 220 of the hydraulically-actuated capsule 200 comprises a base 211 that couples against seat 112 of pump actuator 100. Base 211 and seat 112 can comprise a stable flat-on-flat coupling to prevent tilting of the rotatable hydraulically-actuated capsule 200 with respect to the non-rotatable pump actuator 100. Base 211 can also comprise contouring to facilitate the rotation of the HLA 1 within the hydraulically-actuated capsule 200. Base 211 can comprise slants 241 directing lubricating fluid to a gothic 240. Gothic 240 can be a pseudo-spherical formation or off-set radius formation that controls force vectors and that promotes rotation without adherence of the knurl 440 of the HLA 1 to the receiving portion 116. Knurl 440 can be part of a rotation extension that can comprise an anti-adherence feature 442 such as a divot. Knurl 440 can connect to outer sleeve 410 of HLA 1 via a neck 441.

A hydraulic lash adjuster is within the sleeve. The sleeve 220 comprises a first oil port 225 for receiving fluid for the hydraulic lash adjuster 1 in the hydraulically-actuated capsule. The first oil port 225 can be duplicated in the sleeve 220. Hydraulic fluid can be supplied to the first oil port 225 and its duplicates by oil galleries in the engine block 60 with the hydraulic fluid pressurized to keep the lash adjuster filled. Or, the first oil port 225 and its duplicates can serve a leak-down function to lubricate the roller assembly 31 and cam 30. A cavity 400 between the sleeve 220 and the HLA 1 can house hydraulic fluid. An inner sleeve 420 is slidable in an outer sleeve 410 so that a high pressure chamber 411 and low pressure chamber 421 are formed on either side of a check assembly 450. Check assembly 450 can comprise a ball, flat, or other check device biased against a port in the inner sleeve 420 by a spring in a seating cup. The seating cup can be biased by a spring between the inner and outer sleeves 420, 410. The HLA 1 can account for valve lash.

A cap 500 is coupled to the sleeve 220 and can be coupled to the inner sleeve 420 to control fluid to the low pressure chamber 421. The cap 500 can be sealed or can comprise first and second cap ports 511, 515. The cap 500 can be configured to receive an oil feed from a push tube 40 connected to the cap 500. Pressurized fluid or unpressurized drip fluid supplied by second oil gallery 41 can traverse first cap port 511 to keep low pressure chamber 421 filled with hydraulic fluid. Hydraulic fluid supplied to tube seat 510 can overflow to cap ports 515 and can also or alternatively overflow along the outer side of sleeve 220 to leak down over the two-part lifter 10, lubricating the interfaces and supplying fluid to first oil port 225.

Figure 4:
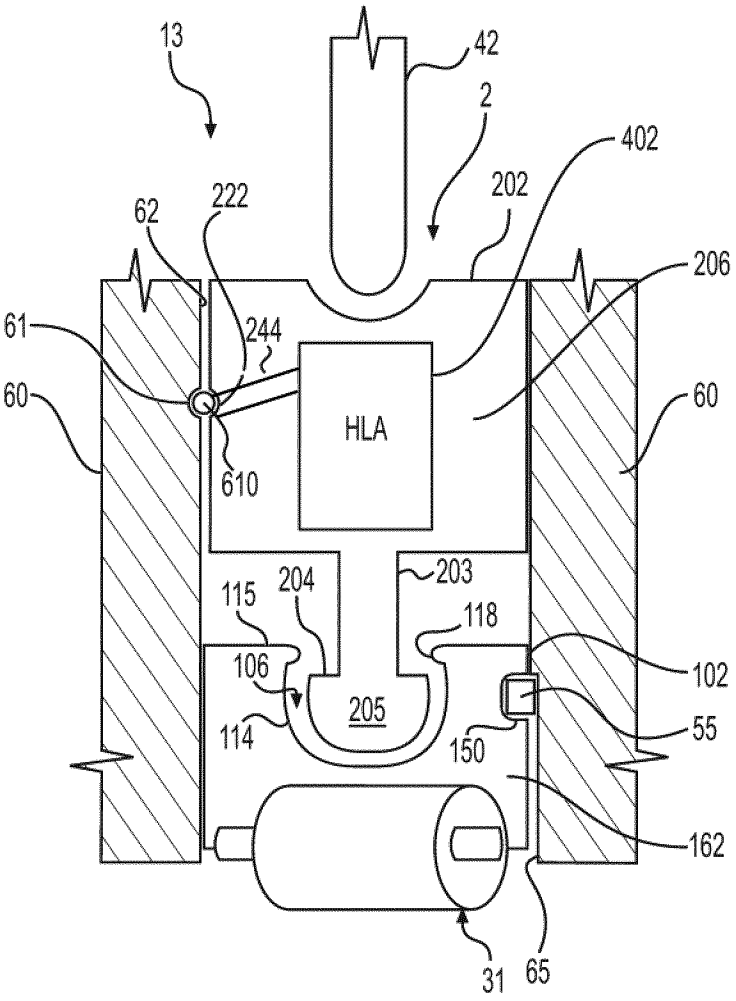
FIGS. 4-7 are views of alternative two-part lifters.

FIG. 4 shows an alternative lifter assembly comprising two-part lifter 13. Engine block 60 comprises an oil gallery 61 with an oil feed 610 coupled to an oil port 222 in hydraulically-actuated capsule 202. A passage 244, which can comprise a cavity, connects the oil port 222 to an insert 402 that can comprise a hydraulic lash adjuster 2 or other hydraulic device. HLA 2 can be embedded in body 206 of hydraulically-actuated capsule 202. With no fluid from the push tube 42, fewer oil passages are included.

Body 206 can comprise a rotation extension comprising a neck 203 and knurl 205 for facilitating rotation of hydraulically-actuated capsule 202 against a gothic 114 in pump actuator 102. A shoulder 204 can be included on the rotation extension to catch against a rim 118 of the receiving portion 106 of pump actuator 102 for secure connection. Main body 162 can comprise an upper edge 115 that does not have to couple against the hydraulically-actuated capsule 202. A gap can be therebetween. As in other discussions, a roller assembly 31 can be mounted to main body 162, as can anti-rotation feature 55 in anti-rotation pocket 150.

An alternative pump actuator 103 is shown in FIG. 3. The receiving portion 113 does not have a rim 118 to facilitate easy removal of the hydraulically-actuated capsule. Upper edge 115 can abut a hydraulically-actuated capsule or comprise a gap therebetween. Instead of a roller assembly 31, a flat tappet 32 is included, comprising a flat base 330 for interfacing with cam 30. Flat base 330 can be sized to prevent the pump actuator 103 from lifting in to the engine block 60.

Figure 7:
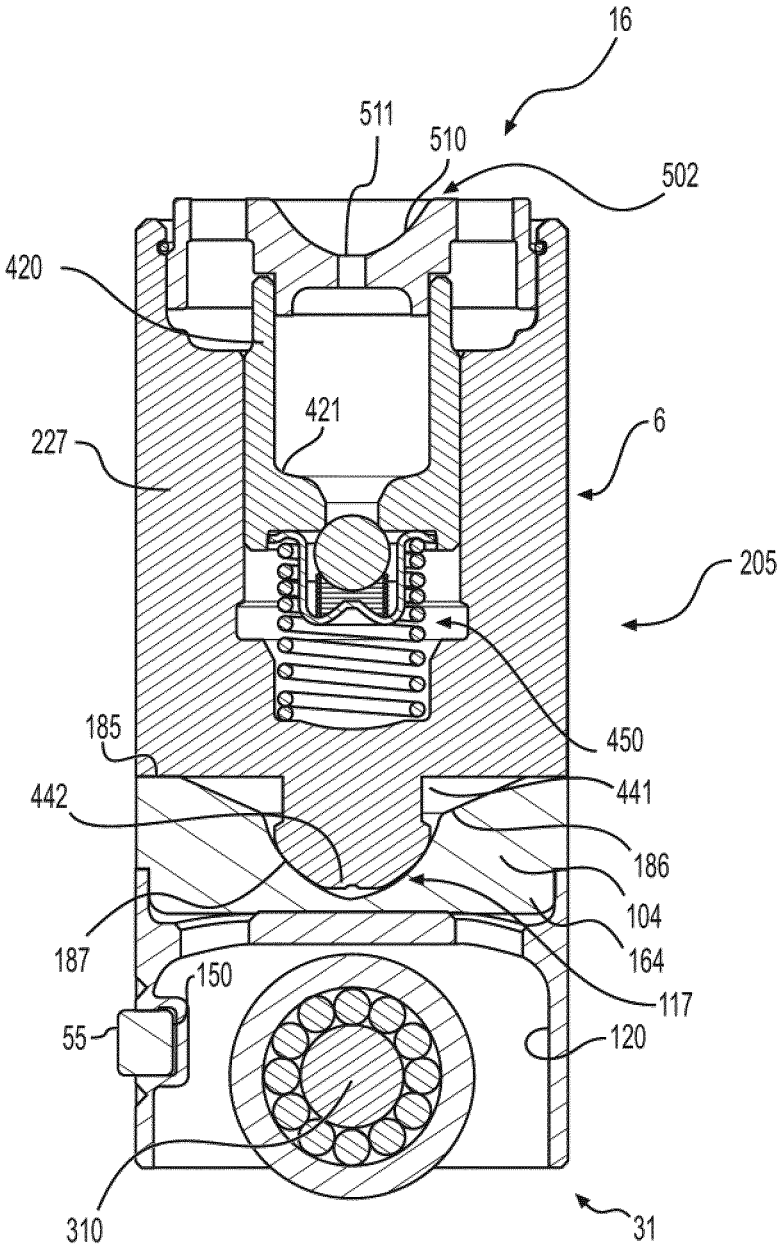

FIG. 7 shows another alternative two-part lifter 16. The hydraulically-actuated capsule 205 can comprise a more unitary configuration where the outer sleeve 227 of the HLA 6 comprises a rotation extension comprising a neck 441 and knurl 442. An oil-fed push tube can couple to cap port 511 to feed oil to the low pressure chamber 421 of HLA 6. Oil can be moved to the high pressure chamber 411 from the low pressure chamber 421. Overflow oil can leak down the outside of the hydraulically-actuated capsule to lubricate the gothic 187 in the receiving portion 117. Slants 186 can direct lubricating overflow oil to the gothic 187. Upper edge 185 of main body 164 can contact a lower edge of the hydraulically-actuated capsule 205 or a gap can be formed therebetween. The main body 164 can comprise an anti-rotation feature 55 or 56 and a roller assembly 31 or flat tappet 32.

Figure 5:
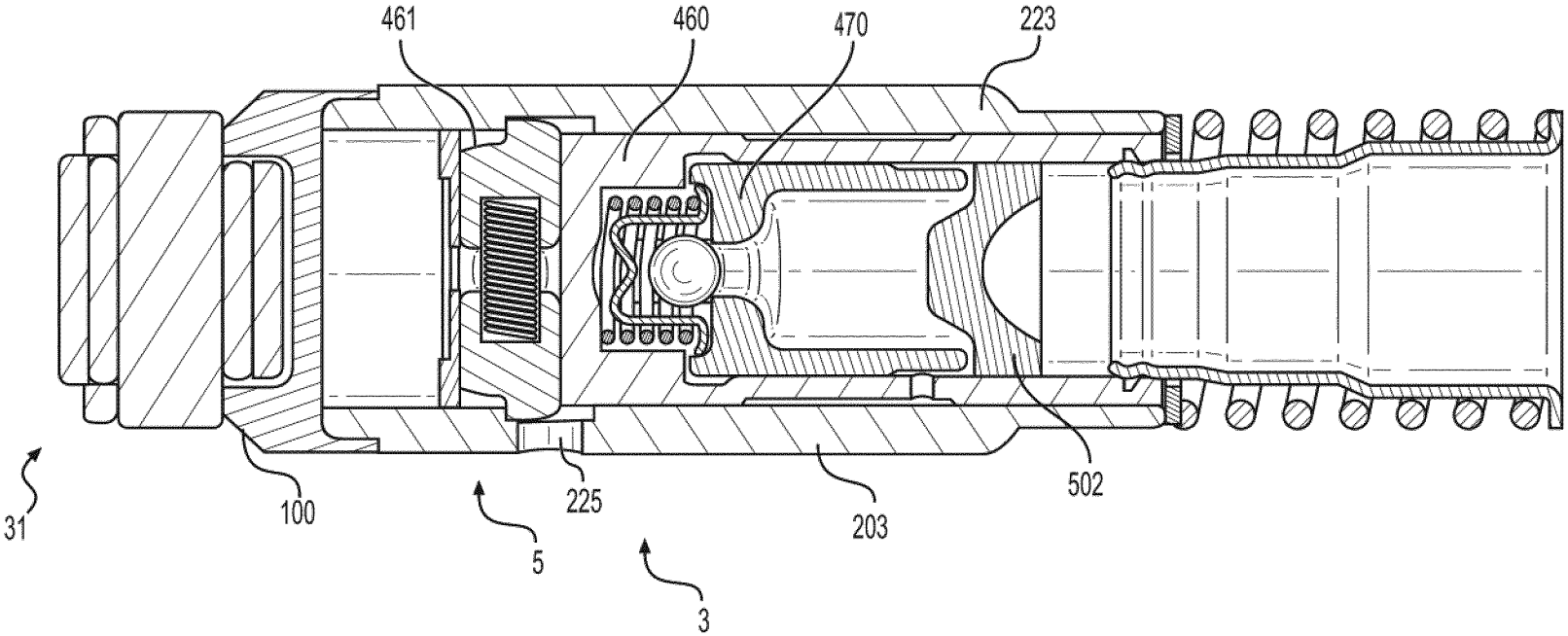
Figure 6:
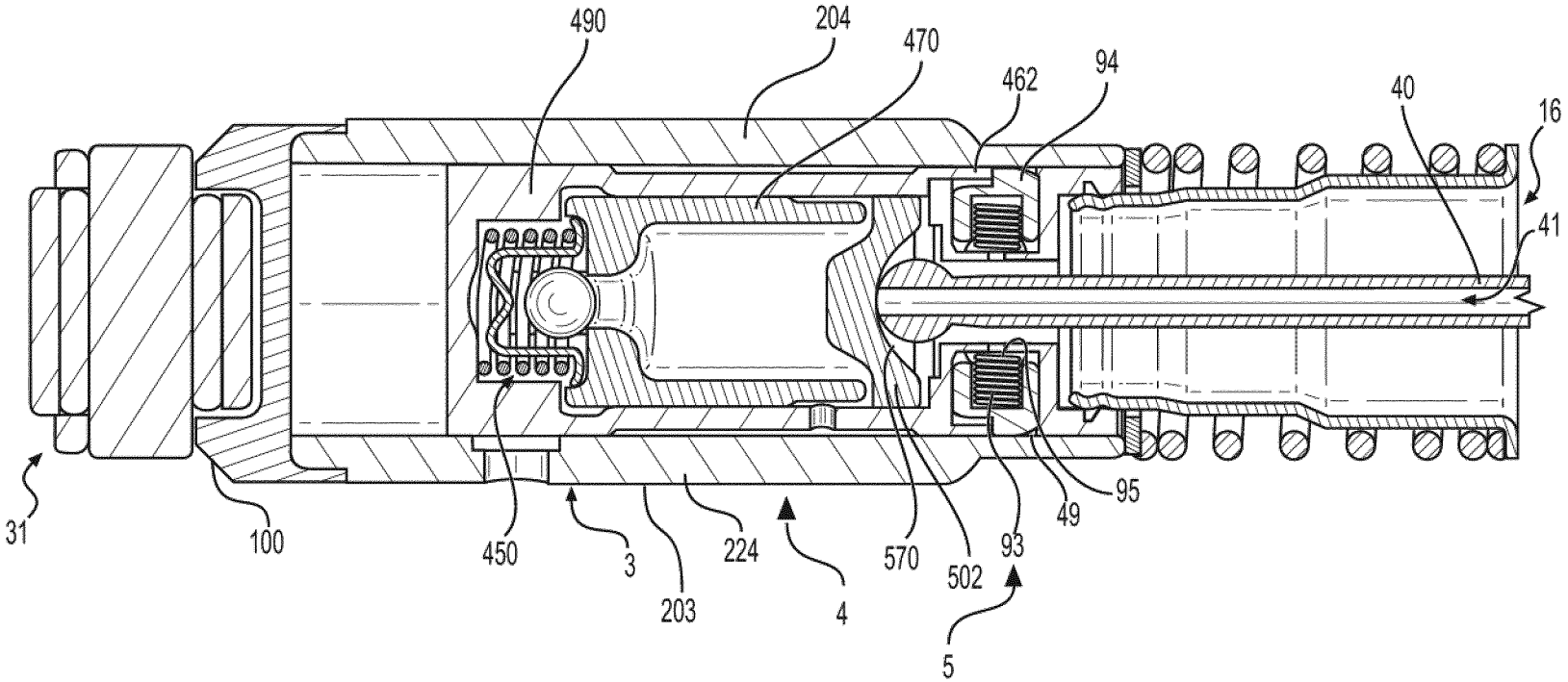

In further alternatives of FIGS. 5 & 6, the hydraulically-actuated capsule 203, 204 comprises a cylinder deactivation assembly 5. The hydraulically-actuated capsule can comprise one or both of a hydraulic lash adjuster assembly and a cylinder deactivation assembly. In the illustrations, the hydraulically-actuated capsule comprises both a hydraulic lash adjuster assembly and a cylinder deactivation assembly. In both FIGS. 5 & 6, the sleeve 223, 224 couples to the pump actuator 100 for rotation there-against, but alternatively without a rotation extension from the internal HLA & CDA insert.

For the two-part lifter 14 of FIG. 5, the engine block 60 comprises an oil gallery 61 for an oil feed 610. The oil feed 610 is connected to an oil port 225 to supply pressurized fluid to actuate the cylinder deactivation assembly 5. Cylinder deactivation assembly 5 can comprise spring-biased latches that respond to the pressurized fluid to collapse away from inner grooves in the sleeve 223 so as to deactivate the valve actuation of one or more affiliated valve 81. In the extended position, the latches of the CDA assembly 5 lock against inner grooves in the sleeve 223 so that the cam profile lifts the whole two-part lifter according to the cam profile.

In FIG. 5, the outer sleeve 460 comprises a CDA pocket 461 so that the hydraulic lash adjuster 3 is between the CDA assembly 5 and the cap 502 of the hydraulically-actuated capsule 203. The cylinder deactivation assembly 5 is between the cam follower (roller assembly 31) and the hydraulic lash adjuster 3 of the two-part lifter. The inner sleeve 470 of the HLA 3 is within the outer sleeve 460, and the cap 502 is recessed in to the outer sleeve 460. An additional spring and push tube guide can be included in the lifter assembly.

In FIG. 6, the hydraulic lash adjuster 4 is between the cam follower (roller assembly 31) and the cylinder deactivation assembly 5. The sleeve 224 can rotate relative to the pump actuator 100. The sleeve 224 can be modified with a side port 225 for supplying pressurized fluid to the HLA 3 and CDA assembly 5 as shown in FIG. 5. Or, as illustrated, the sleeve 224 can permit external leak down, and can be internally configured so that the push tube 40 passes through the CDA assembly 5 to supply pressurized fluid through its internal oil gallery 41. Pressurized fluid can be received in a gothic 510 of cap 502 and can travel to CDA ports 95 to selectively actuate latches 94 biased by springs 93. CDA assembly 5 can be in an alternative CDA pocket 462 in outer sleeve 490 or CDA assembly 5 can be an insert stacked above outer sleeve 490. Cap 502 can be fitted within outer sleeve 490 and on inner sleeve 470. Latches 94 can selectively lock against inner grooves in the sleeve 224. Alternatively, CDA assembly 5 can be seated in the HLA 3, in contact with the outer sleeve 490 so that the latches 94 selectively lock against inner grooves in the outer sleeve 490. Cap 502 can be seated on top of the CDA assembly 5.

The lifter assembly 15 can comprise a valve actuation assembly mounted to an engine block. A valve assembly 81 comprising a valve connected to a valve stem is connected to a rocker arm 51 or 52. The rocker arm can comprise at least a first oil gallery 53 or 57. A push tube 40 connected to the rocker arm comprises a second oil gallery 41 connected to the first oil gallery. The hydraulically-actuated capsule 204 fluidly couples to the push tube 40 and is configured to receive an oil feed from the second oil gallery 41. The second oil gallery 41 supplies actuation fluid to the hydraulically-actuated capsule 204.

Other implementations will be apparent to those skilled in the art from consideration of the specification and practice of the examples disclosed herein.

What is claimed is:

1. A lifter assembly for a cam-actuated engine, the lifter assembly comprising:

a lifter comprising:

a pump actuator comprising:

a main body configured to lift and lower in a lifter recess and configured to receive an anti-rotation insert or an alignment bar;

a receiving portion comprising a rim extending from the main body; and a cam follower comprising a roller assembly or a flat tappet integrated to the main body on a side opposite to the receiving portion, the cam follower configured to follow a rotating cam; and a hydraulically-actuated capsule seated against the receiving portion and extending from the rim so as to lift, lower, and rotate against the lifter recess, the hydraulically-actuated capsule configured to rotate with respect to the pump actuator.

2. The lifter assembly of claim 1, wherein the hydraulically-actuated capsule further comprises a sleeve mounted to the receiving portion.

3. The lifter assembly of claim 2, wherein the sleeve comprises a first oil port.

4. The lifter assembly of claim 3, wherein the hydraulically-actuated capsule comprises a hydraulic lash adjuster assembly and a cylinder deactivation assembly.

5. The lifter assembly of claim 4, wherein the hydraulic lash adjuster is between the cam follower and the cylinder deactivation assembly.

6. The lifter assembly of claim 4, wherein the cylinder deactivation assembly is between the cam follower and the hydraulic lash adjuster.

7. The lifter assembly of claim 2, further comprising a cap coupled to the sleeve, wherein the cap is configured to receive an oil feed from a push tube connected to the cap.

8. The lifter assembly of claim 7, wherein the hydraulically-actuated capsule comprises a cylinder deactivation assembly, and wherein the oil feed is configured to supply pressurized fluid to the cylinder deactivation assembly.

9. The lifter assembly of claim 1, wherein the hydraulically-actuated capsule comprises at least one of a hydraulic lash adjuster assembly or a cylinder deactivation assembly.

10. The lifter assembly of claim 1, further comprising a valve actuation assembly mounted to an engine block, the valve actuation assembly comprising:

a valve connected to a valve stem;

a rocker arm connected to the valve stem, wherein the rocker arm comprises first oil gallery;

a push tube connected to the rocker arm, the push tube comprising a second oil gallery connected to the first oil gallery; and the hydraulically-actuated capsule fluidly coupled to the push tube and configured to receive an oil feed from the second oil gallery.

11. The lifter assembly of claim 10, wherein the engine block comprises the lifter recess, wherein the lifter is mounted in the lifter recess, wherein the main body comprises an anti-rotation pocket recessed into the main body, and wherein the lifter assembly comprises the anti-rotation insert mounted in the anti-rotation pocket.

12. The lifter assembly of claim 10, further comprising the alignment bar mounted in the lifter recess, and wherein the main body is configured to lift and lower relative to the alignment bar such that the main body cannot twist in the lifter recess against the alignment bar.

13. The lifter assembly of claim 12, wherein the lifter recess comprises a lubrication gallery and wherein the alignment bar is mounted in the lubrication gallery.

14. The lifter assembly of claim 10, wherein the main body further comprises the anti-rotation insert configured to lift and lower in the lifter recess while preventing rotation of the main body.

15. A lifter for a cam-actuated engine, the lifter comprising:

a pump actuator comprising:

a main body configured to lift and lower against a lifter recess;

a receiving portion comprising a gothic recessed from an upper edge; and a cam follower comprising a roller assembly or a flat tappet integrated to the main body on a side opposite to the receiving portion, the cam follower configured to follow a rotating cam; and a hydraulically-actuated capsule configured to rotate, lift, and lower against the lifter recess, the hydraulically-actuated capsule comprising a knurl on a rotation extension, the knurl configured to rotate in the gothic.

16. The lifter of claim 15, wherein the main body further comprises an anti-rotation insert configured to lift and lower in the lifter recess while preventing rotation of the main body.

17. The lifter of claim 15, further comprising an alignment bar, wherein the main body further comprises an alignment pocket configured to lift and lower in the lifter recess while abutting the alignment bar.

18. A lifter for a cam-actuated engine, the lifter comprising:

a pump actuator comprising:

a main body configured to lift and lower in a lifter recess;

a receiving portion comprising a seat on a first side of the main body; and a cam follower comprising a roller assembly or a flat tappet integrated to the main body on a second side opposite to the receiving portion, the cam follower configured to follow a rotating cam;

a sleeve configured to lift, lower, and rotate in the lifter recess, the sleeve comprising a base coupled to rotate in the seat; and at least one of a hydraulic lash adjuster assembly or a cylinder deactivation assembly configured to rotate in the sleeve.

19. The lifter of claim 18, wherein the main body further comprises an anti-rotation insert configured to lift and lower in the lifter recess while preventing rotation of the main body.

20. The lifter of claim 18, wherein the main body further comprises an alignment pocket configured to lift and lower in the lifter recess while abutting an alignment bar.

* * * * *